United States Patent [19]

Bellmann

[11] 4,418,664

[45] Dec. 6, 1983

[54] MODULAR PUMP-NOZZLE UNIT FOR AN INTERNAL COMBUSTION ENGINE

[75] Inventor: Walter Bellmann, Esslingen-Sulgries, Fed. Rep. of Germany

[73] Assignee: Daimler-Benz Aktiengesellschaft, Fed. Rep. of Germany

[21] Appl. No.: 211,904

[22] Filed: Dec. 1, 1980

[30] Foreign Application Priority Data

Dec. 1, 1979 [DE] Fed. Rep. of Germany ..... 2948407

[51] Int. Cl.[3] ..... F02M 47/02

[52] U.S. Cl. ..... 123/273; 239/90; 239/88

[58] Field of Search ..... 239/88, 89, 90, 91, 239/92, 600; 123/273

[56] References Cited

U.S. PATENT DOCUMENTS

| | | | |
|---|---|---|---|
| 1,909,014 | 5/1933 | Schaeren | 239/89 |
| 1,934,580 | 11/1933 | Woolson | 239/88 |
| 1,981,551 | 11/1934 | Hermann | 239/90 |
| 2,053,312 | 9/1936 | Amery | 239/88 |
| 2,260,077 | 10/1941 | Kearney | 239/90 |
| 2,408,288 | 9/1946 | Bremser | 239/88 |
| 2,584,408 | 2/1952 | Witzky | 239/89 |
| 2,688,516 | 9/1954 | Bell | 239/91 |
| 4,213,564 | 7/1980 | Hulsing | 239/88 |

FOREIGN PATENT DOCUMENTS

| | | | |
|---|---|---|---|
| 740599 | 1/1933 | France | 239/88 |
| 132905 | 9/1951 | Sweden | 239/88 |
| 135565 | 12/1929 | Switzerland | 239/88 |
| 351473 | 6/1931 | United Kingdom | 239/88 |

*Primary Examiner*—Ronald B. Cox

*Attorney, Agent, or Firm*—Craig & Burns

[57] ABSTRACT

A modular pump-nozzle unit for internal combustion engines, especially air-compressing, fuel-injected internal combustion engines, with precombustion chamber injection. The modular pump-nozzle unit includes a pump element having a pump piston and an injection nozzle. The pump element and the injection nozzle are in communication by way of a connecting duct. The pump element is arranged adjacent to the injection nozzle.

14 Claims, 1 Drawing Figure

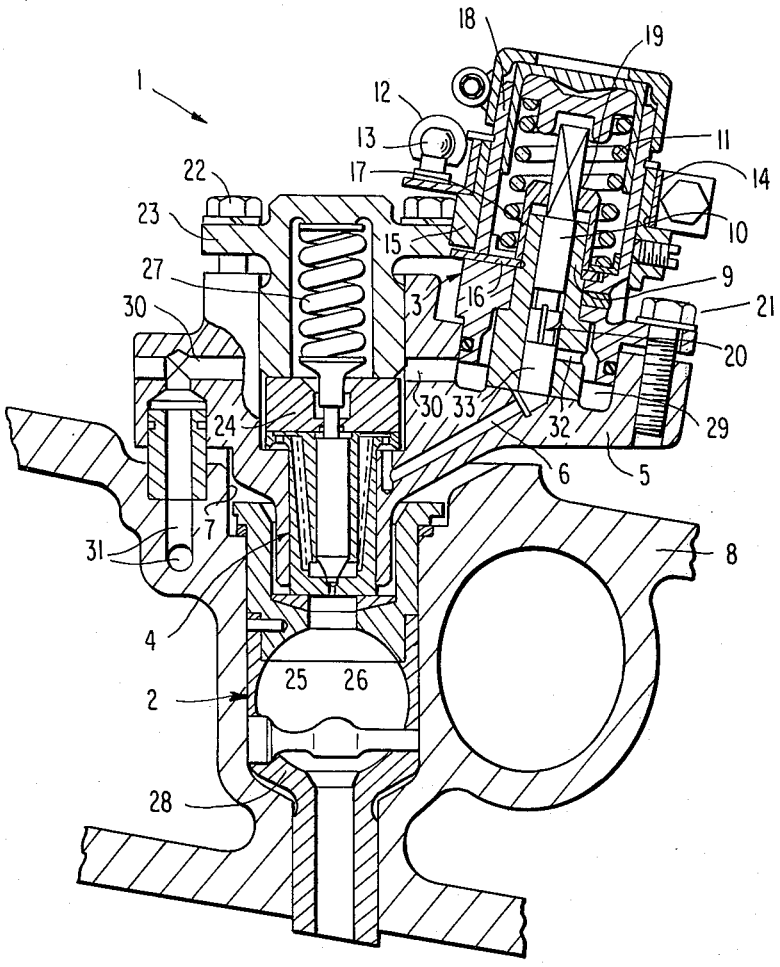
1
2
3
4
5
6
7
8
9
10
11
12
13
14
15
16
17
18
19
20
21
22
23
24
25
26
27
28
29
30
31
32
33

MODULAR PUMP-NOZZLE UNIT FOR AN INTERNAL COMBUSTION ENGINE

The present invention relates to a pump-nozzle unit and, more particularly, to a modular pump-nozzle unit for internal combustion engines, especially for air-compressing fuel injected internal combustion engines with precombustion chamber ignition, which unit includes a pump element having a pump piston and an injection nozzle connected to the pump element through a connecting duct.

Pump-nozzle units of the aforementioned type have been proposed in, for example, German Patent Application No. P 28 55 539.7, wherein an axis of the nozzle needle of the injection nozzle and the axes of the pump piston of the pump element are arranged coaxially to one another. The pump-nozzle module is driven by way of a cam of a cam shaft. In this connection, the pump axis must lie in a plane extending at right angles to the camshaft and, by this pump location, the position of the nozzle axis is also likewise determined.

The aim underlying the present invention essentially resides in providing a modular pump-nozzle unit of the aforementioned type adapted to be disposed between the cam of a camshaft and a cylinder head in such a manner that the nozzle position may be selected independently of the position of the pump.

In accordance with advantageous features of the present invention, the pump element is disposed adjacent to the injection nozzle. By virtue of such an arrangement of the nozzle with respect to the pump, the nozzle position may be optimally adapted to the requirements of a diesel process. Moreover, due to the special correlation, a substantially lower structural height is obtained thereby enabling a flatter configuration of a forward structure of a motor vehicle when the engine is disposed therein.

Preferably, the pump piston of the pump element is located at a level of a spring housing of the injection nozzle with a compression spring of the spring housing cooperating with a nozzle needle of the injection nozzle.

In accordance with further advantageous features of the present invention, the modular pump-nozzle unit includes a base member provided as a support for the pump element and the injection nozzle so that it is possible to effect, in an installed condition, an exchanging of the injection nozzle without removing or dismantling the rocker arm and camshaft. Thus, the injection nozzle may be removed from the base member separately from the pump element.

In accordance with further advantageous features of the present invention, the connecting duct extending between the pump element and leading to the injection nozzle is arranged in the base member and, preferably, is integrally cast with the base member.

In accordance with a further development of the present invention, the base member is provided with a feed duct which feeds the fuel to the pump element, so that it is possible to eliminate the voluminous by-pass fuel lines and thus prevent leakage due to ruptures in the feed hoses or conduits and thus lubricating oil dilution by fuel leaking from the hoses or conduits.

In order to facilitate a mounting of the modular unit, in accordance with the present invention, the base member of the pump-nozzle unit is adapted to be inserted in a cylindrical recess in the cylinder head and fixed in position by means of clamping screws at the cylinder head.

Accordingly, it is an object of the present invention to provide a modular pump-nozzle unit which avoids, by simple means, shortcomings and disadvantages encountered in the prior art.

Another object of the present invention resides in providing a modular pump-nozzle unit for an internal combustion engine which enables a positioning of the nozzle independently of a position of the pump.

A further object of the present invention resides in providing a modular pump-nozzle unit for internal combustion engines which exhibits a substantially lower structural height.

A further object of the present invention resides in providing a modular pump-nozzle unit for an internal combustion engine which enables a separate servicing of the injection nozzle and the pump.

A still further object of the present invention resides in providing a modular pump-nozzle unit for internal combustion engines which dispenses with the need for bypass fuel lines.

Yet another object of the present invention resides in providing a modular pump-nozzle unit for internal combustion engines which is simple in construction and, therefore, relatively inexpensive to manufacture.

A further object of the present invention resides in providing a modular pump-nozzle unit for an internal combustion engine which functions reliably under all load conditions of the engine.

These and other objects, features and advantages of the present invention become more apparent from the following description when taken in connection with the accompanying drawing, which shows, for the purposes of illustration only, one embodiment in accordance with the present invention, and/or in:

The single FIGURE of the drawing is a cross-sectional view of a modular pump-nozzle unit for an internal combustion engine in accordance with the present invention.

Referring now to the single FIGURE of the drawing, according to this FIGURE, a modular pump-nozzle unit generally designated by the reference numeral 1 for an air-compressing fuel-injected internal combustion engine with a precombustion chamber generally designated by the reference numeral 2 includes two groups of components, with the first group of components including a pump element generally designated by the reference numeral 3 adapted to be driven by a cam (not shown) of a camshaft of an internal combustion engine (not show) and a second group of components formed by an injection nozzle generally designated by the reference numeral 4.

The injection nozzle 4 and pump element 3 are arranged in a side-by-side relationship and are attached to a common or combined base member 5. A connecting duct 6 extends from the pump element 3 and leads to the injection nozzle 4. Preferably, the connecting duct 6 is integrally cast with the base member 5. The base member 5 is adapted to be accommodated or sit in a cylindrical recess 7 provided in a cylinder head 8 of the internal combustion engine.

The pump element 3 of the pump-nozzle 1 includes a pump piston 10 which is adapted to be longitudinally displaceably guided in a pump cylinder 9 and held in the illustrated position by a compression spring 11. A linkage 12, provided for fuel volume or quantity regulation, engages a spherical head 13 of a clamping ring 14. The clamping ring 14 is non-rotatably connected, through a bushing 15, with a finger 16 of a sleeve 17 surrounding the pump cylinder 9. The bushing 15 is mounted on a pump housing 18 so as to be rotatably supported thereon. The sleeve 17 is provided with a rectangular portion 19 in the form of, for example, a square, so as to enable an adjustment of the pump piston 10 in a direction of rotation whereby, as is customary in fuel-injection pumps, the injected quantity of fuel is influenced with the aid of a control edge 20 at the pump piston 10. The pump element 3 and the injection nozzle 4 are threadedly joined to the base member 5 by means of suitable fasteners such as, for example, tightening screws 21, 22.

The injection nozzle 4 of the pump-nozzle unit 1 includes a spring housing 23, a connecting member 24 and a nozzle body 25. A nozzle needle 26 is accommodated in the nozzle body 25 and is guided so as to be longitudinally displaceable against the biasing force of pressure of a spring 27 arranged in a spring housing 23.

The pump nozzle module is attached to the base member 5 at the cylinder head 8 by means of suitable fasteners such as, for example, two clamping screws (not shown). By virtue of the special manner of mounting the pump-nozzle module of the present invention, a precombustion chamber insert 28, lying in the cylindrical recess 7 and the cylinder head 8, is clamped in place by way of the base member 5.

A further feed or inlet duct 30 is formed in the base member 5 adjacent to the connecting duct 6. Advantageously, the feed or inlet duct 30 is integrally cast with the base member 5. The feed duct 30 terminates in a pressure chamber 29 and is in communication with a duct 31 cast into the cylinder head 8. The feed or inlet duct 30 is provided for supplying fuel to the pump element 3. A control bore 32 is provided for communicating a pump working chamber 33 of the pump element 3 with the pressure chamber 29.

The association of the fuel injection nozzle 4 with the pump element 3, which pump element 3 is fixed in position by the camshaft, is such that the spring housing 23 of the injection nozzle 4 and the pump piston 10 of the pump element 3 are at the same level so as to enable the achievement of a low structural height of the pump-nozzle unit 1.

By virtue of the provision of a fuel-feed system of the type described hereinabove, fuel feed lines beneath the cylinder head or rocker arm cover of the internal combustion engine become superfluous. Moreover, since the pump-nozzle unit is accommodated beneath the cylinder head or rocker arm cover, the noise produced during fuel injection may be damped. Furthermore, by virtue of the arrangement of the present invention, there is no danger of any rupturing or breaking of hose connections which would lead to a concomitant lubricating oil dilution by the fuel.

While I have shown and described only one embodiment in accordance with the present invention, it is understood that the same is not limited thereto, but is susceptible to numerous changes and modifications as known to one having ordinary skill in the art, I therefore do not wish to be limited to the details shown and described herein, but intend to cover all such modifications as are encompassed by the scope of the appended claims.

I claim:

1. A pump-nozzle unit for internal combustion engines combined into one individual unit having a pump element with a pump piston, having an injection nozzle disposed next to said pump element, and having a basic unit serving as the support for the pump element and the injection nozzle, with said basic unit being firmly inserted in a recess disposed in the cylinder head, and having a spring housing located in the injection nozzle at the level of the pump piston, with said spring housing having a pressure spring interacting with a nozzle needle of the injection nozzle, characterized in that the injection nozzle as a whole can be removed separately from the pump element from the basic unit remaining at the cylinder head.

2. A modular pump-nozzle unit according to claim 1, characterized in that the injection nozzle includes a nozzle needle means, a compression spring means for biasing the nozzle needle means, a spring housing means for accommodating the compression spring means, and in that the pump piston of the pump element and the spring housing means lie at the same level.

3. A modular pump-nozzle unit according to one of claims 1 or 2, characterized in that the mounting means includes a base member for supporting the pump element and the injection nozzle.

4. A modular pump-nozzle unit according to claim 3, characterized in that the communicating means is a connecting duct arranged in the base member.

5. A modular pump-nozzle unit according to claim 4, characterized in that the connecting duct is integrally cast in the base member.

6. A modular pump-nozzle unit according to claim 4, characterized in that the base member further includes means for supplying fuel to the pump element.

7. A modular pump-nozzle unit according to claim 6, characterized in that the fuel supplying means is a feed duct provided in the base member.

8. A modular pump-nozzle unit according to claim 7, characterized in that the feed duct is integrally cast in the base member.

9. A modular pump-nozzle unit according to claim 7, characterized in that the base member is adapted to be inserted in a recess of a cylinder head of the internal combustion engine, and in that means are provided for attaching the base member to the cylinder head.

10. A modular pump-nozzle unit according to one of claims 1 or 2, characterized in that the communicating means is a connecting duct arranged in the mounting means.

11. A modular pump-nozzle unit according to claim 10, characterized that the connecting duct is integrally cast with the mounting means.

12. A modular pump-nozzle unit according to one of claims 1 or 2, characterized in that means are provided in the mounting means for supplying fuel to the pump element.

13. A modular pump-nozzle unit according to claim 12, characterized in that the supplying means is a feed duct integrally cast in the mounting means.

14. A modular pump-nozzle unit according to one of claims 1 or 2, characterized in that the mounting means are adapted to be inserted in a recess of the cylinder head of the internal combustion engine, and in that means are provided for attaching the mounting means to the cylinder head.

* * * * *